US007467961B2

(12) United States Patent
Kuo

(10) Patent No.: US 7,467,961 B2
(45) Date of Patent: Dec. 23, 2008

(54) ELECTRICAL CONNECTOR ASSEMBLY WITH SPRINGS

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/897,149

(22) Filed: Aug. 29, 2007

(65) Prior Publication Data

US 2008/0057764 A1 Mar. 6, 2008

(51) Int. Cl.
*H01R 13/64* (2006.01)

(52) U.S. Cl. ..... 439/248

(58) Field of Classification Search ..... 439/246, 439/247, 248, 378
See application file for complete search history.

(56) References Cited

U.S. PATENT DOCUMENTS 6,155,858 A 12/2000 Ozawa et al.
6,322,382 B1 * 11/2001 Viallet ..... 439/248
6,527,572 B2 * 3/2003 Jou ..... 439/248
6,592,387 B2 * 7/2003 Komenda et al. ..... 439/247
7,090,521 B2 8/2006 Nishio et al.
7,121,857 B1 * 10/2006 Lewis ..... 439/247
7,128,602 B1 * 10/2006 Cromwell et al. ..... 439/540.1
7,201,594 B2 * 4/2007 van der Mee et al. ..... 439/247

* cited by examiner

*Primary Examiner*—Hae Moon Hyeon
(74) *Attorney, Agent, or Firm*—Wei Te Chung

(57) ABSTRACT

An electrical connector assembly (100) includes a top shell (11), a bottom shell (12) forming a bottom plate (32) defining a receiving room with the top shell, a connector module (51), a printed circuit board (PCB) (52) electrically connecting with the connector module, a pair of mating screws (43) and a pair of spring members (430). The top shell forms a cutout (110) exposed along a vertical direction. The connector module is located vertically in the receiving room and extends through the cutout. The PCB includes a pair of limiting holes (521) and the mating screws have threads and screw caps. The threads pass through the bottom plate and the corresponding limiting holes to lock with the top shell. The pair of spring members is supported by the mating screws, and compressed between a bottom surface of the PCB and a top surface of the screw caps.

20 Claims, 5 Drawing Sheets

ELECTRICAL CONNECTOR ASSEMBLY WITH SPRINGS

BACKGROUND OF THE INVENTION

1. Field of the Invention

The present invention relates generally to an electrical connector assembly, and particularly to such an electrical connector assembly with a plurality of springs.

2. Description of Related Arts

A so-called floating connector is known. The floating connector is used in a connector apparatus which comprises a plug (plug connector) and a receptacle (receptacle connector). In such a floating connector, either a plug connector or a receptacle connector is movably provided on a base in a floating state so as to be able to absorb misalignment between the floating connector and a mating connector to be connected when connecting these two connectors. As conventional floating connector, its disclosure in the following publication is known: U.S. Pat. No. 6,155,858. As disclosed in the above floating connector, rubber members or arms made of a resin material are used for producing a floating state. However, such a floating connector using the rubber members or arms has a problem that a good floating function cannot be maintained and a restoring function to a normal position is becoming decreased since the materials of the rubber members and the arms are likely to be deteriorated due to a long-term use. Further, there is another problem that it is difficult to precisely control a stroke of the floating action of the connector.

A floating connector with a pair of springs shown in U.S. Pat. No. 7,090,521 has solved problems mentioned above. The floating connector includes a connector having a base side, a flange-like connecting portion provided on the base side of the connector, a base for supporting the connecting portion, and a pair of coil springs provided between the connecting portion and the base for supporting the connector in a floating state. The coil springs are supported by coil spring receiving portions provided in the connecting portion and coil spring supporting bosses provided on the base so that the coil springs can extend and contract in an inserting direction of a mating connector to be connected as well as to bend laterally in swing directions of the connector. However, sometimes, the coil springs endure different compressive stresses when different mating connectors are inserted, and the inserting force is always changed in direction and intensity while the spring in prior arts keeps a fixed state, thus, resulting in a destroying effect on the electrical connector when the mating connector is inserted because of an excessively large or excessively small friction force. So, an improved electrical connector assembly is desired that a user can adjust the coefficient of elasticity of the coil springs to fit different inserting force.

Hence, an improved electrical connector assembly is desired.

SUMMARY OF THE INVENTION

Accordingly, an object of the present invention is to provide an electrical connector assembly to fit different inserting force.

To achieve the above object, an electrical connector assembly includes a top shell, a bottom shell forming a bottom plate defining a receiving room with the top shell, a connector module, a printed circuit board (PCB) electrically connecting with the connector module, a pair of mating screws and a pair of spring members. The top shell forms a cutout exposed along a vertical direction. The connector module is located vertically in the receiving room and extends through the cutout. The PCB includes a pair of limiting holes and the mating screws have threads and screw caps. The threads pass through the bottom plate and the corresponding limiting holes to lock with the top shell. The pair of spring members is supported by the mating screws, and compressed between a bottom surface of the PCB and a top surface of the screw caps.

Other objects, advantages and novel features of the invention will become more apparent from the following detailed description when taken in conjunction with the accompanying drawings.

DETAILED DESCRIPTION OF THE PREFERRED EMBODIMENT

Figure 1:
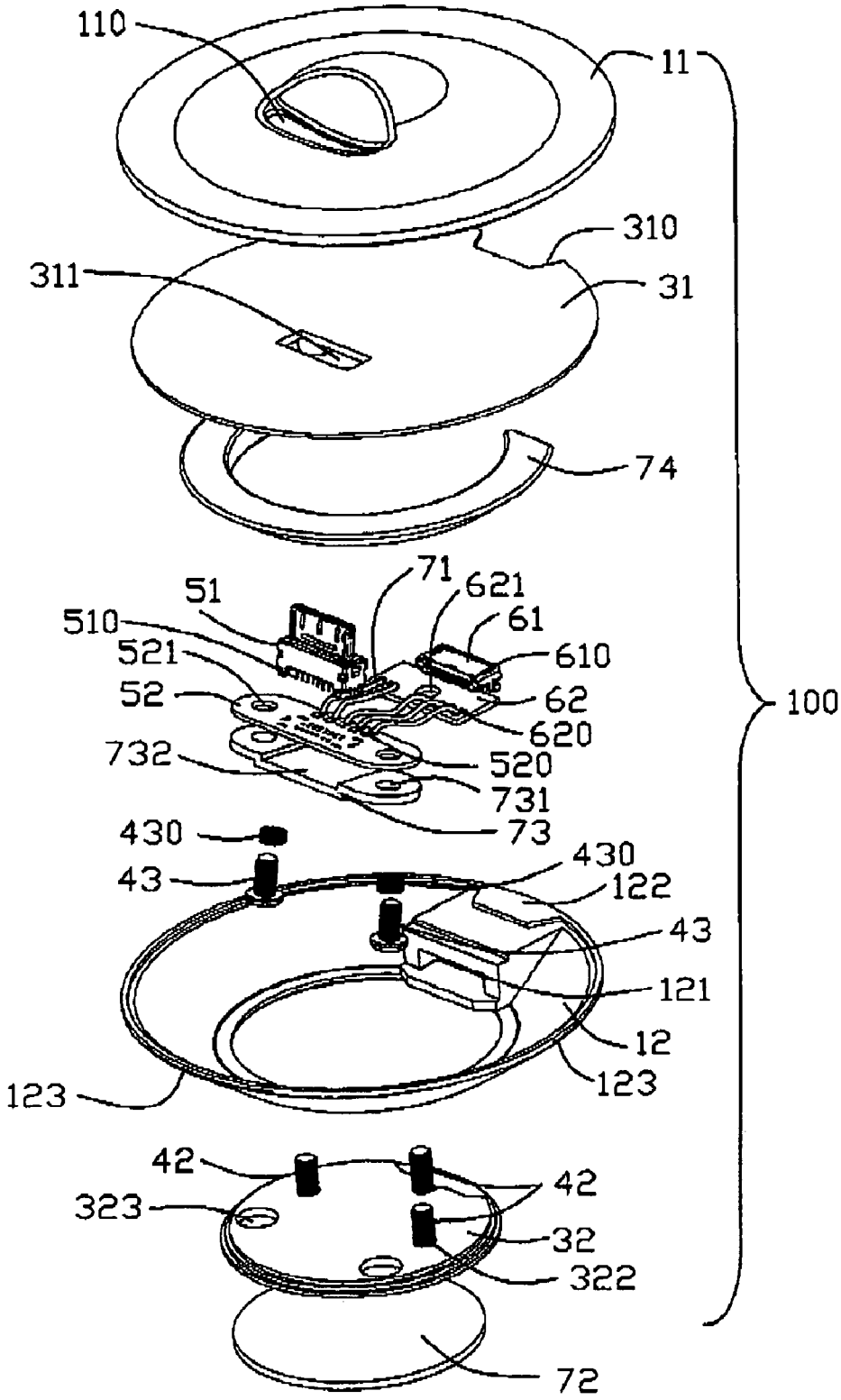
FIG. 1 is an exploded view of an electrical connector assembly in accordance with the present invention.

Referring to FIG. 1, the invention is embodied in an electrical connector assembly 100 comprising a top shell 11, a bottom shell 12, a fixing board 31 located between the top shell 11 and the bottom shell 12, a bottom plate 32 locking with the bottom shell 12, a first connector module 51 having a plurality of contacts 510 and a second connector module 61 having a plurality of terminals 610. The contacts 510 of the first connector module 51 and the terminals 610 of the second connector module 61 are respectively soldered on a first printed circuit board (PCB) 52 and a second printed circuit board (PCB) 62 and the two PCBs 52, 62 electrically contact with each other by cable wires 71, all of these members are received in a receiving room (not labeled) formed by the fixing board 31, the bottom plate 32 and the bottom shell 12. The electrical connector assembly 100 further comprises a plurality of fixing screws 42 and a pair of mating screws 43, each of the screws 42, 43 has a thread (not labeled) and a screw cap (not labeled). A bottom board 72 made of rubber material is used for enhancing friction force between the electrical connector assembly 100 and a device which the electrical connector assembly 100 is placed on. A base 73 is situated below the first PCB 52 and a metal frame 74 is received in the bottom shell 12 for increasing gravity of the whole electrical connector assembly 100.

Figure 4:
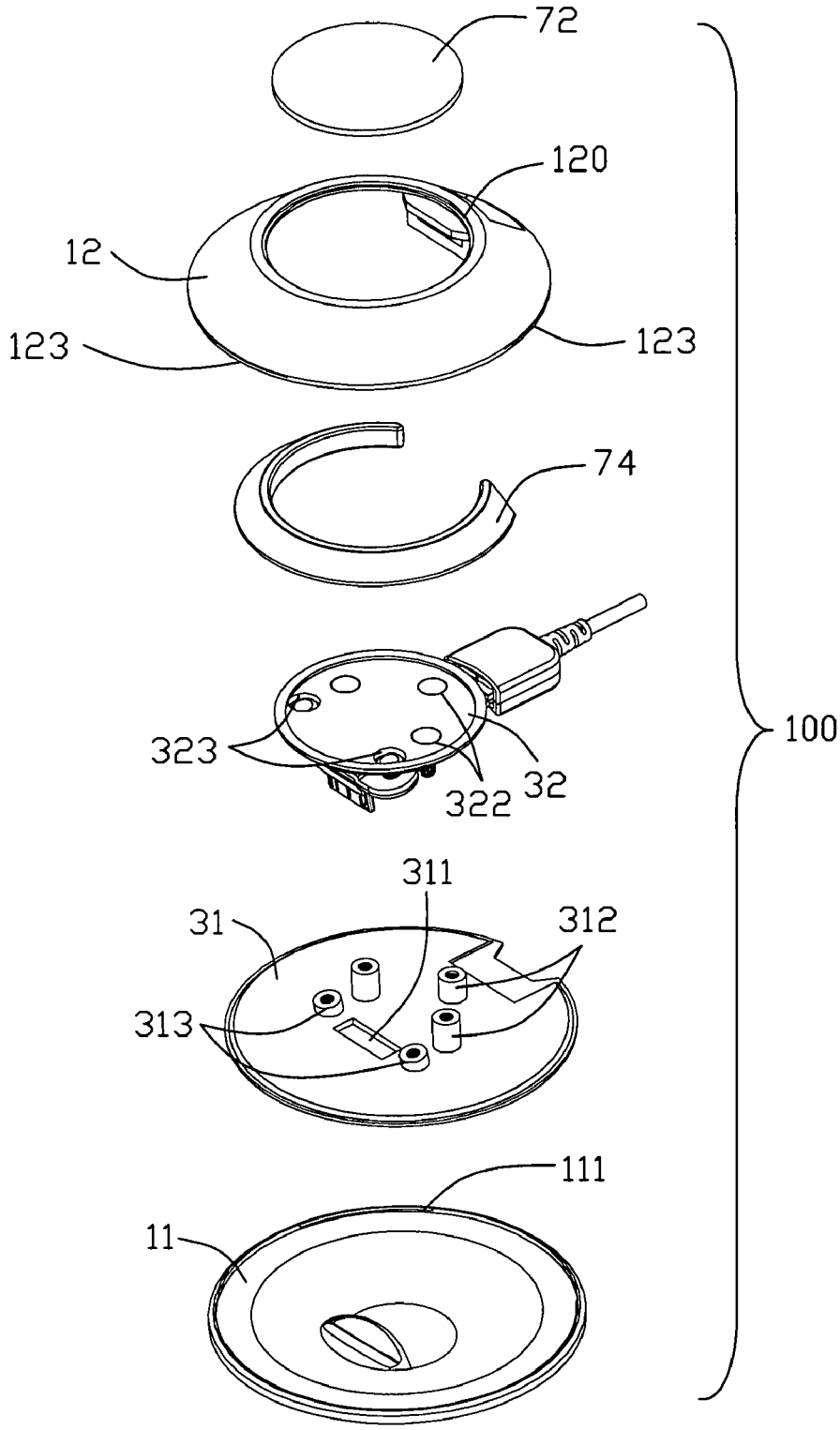
FIG. 4 is a view similar to FIG. 1, but taken from a different aspect.
Figure 5:
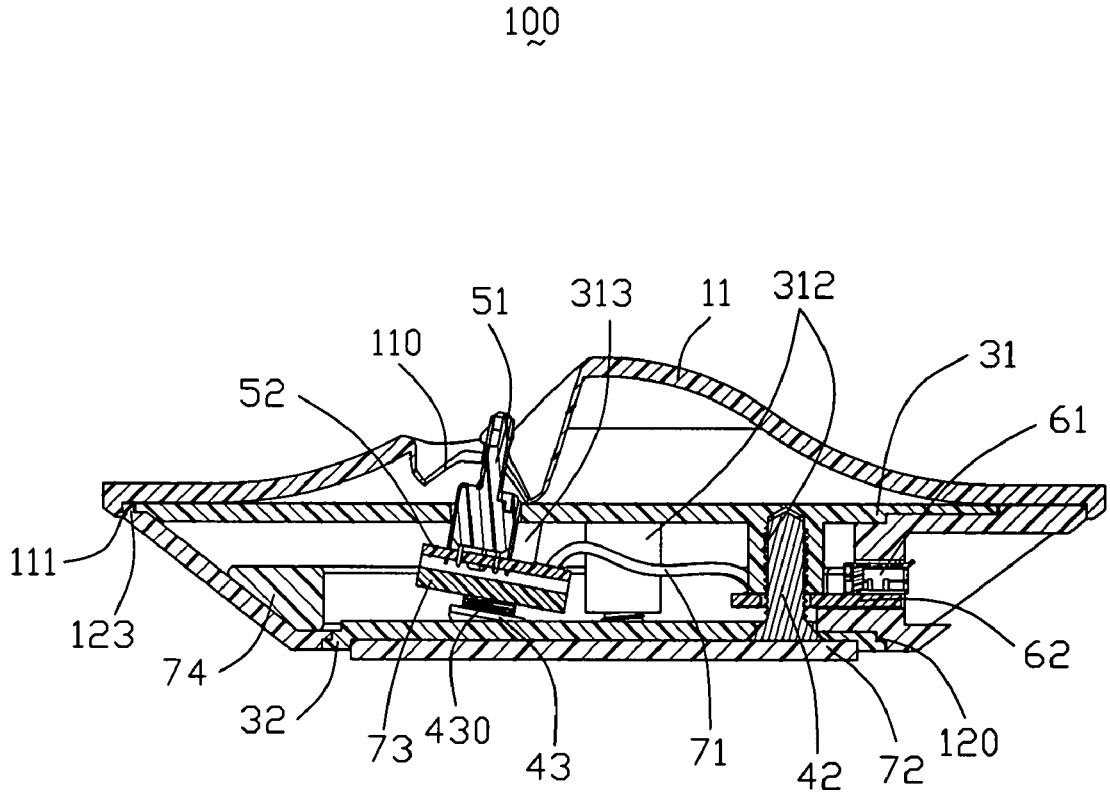
FIG. 5 is a cross-section view of the electrical connector assembly.

Referring to FIGS. 1, 4 and 5, the top shell 11 comprises a first cutout 110 and a number of hooks 111. The first cutout 110 is disposed to allow the first connector module 51 to go through. The bottom shell 12 comprises a circular wall, a plurality of slots 123 cooperating with the corresponding hooks 111, a protruding portion 122, a receiving portion 121 receiving the second connector module 61 and an annular protruding edge 120 confronting the bottom plate 32. A second cutout (not labeled) communicating with the receiving portion 121 is formed on the bottom shell 12 with a mouth exposing along the horizontal direction.

Referring to FIGS. 1 and 4, the fixing board 31 comprises an opening 310 for receiving the protruding portion 122 of the bottom shell 12, a split 311 corresponding to the first cutout 110 along a vertical direction and permitting the first connector module 51 to pass through, a plurality of fixing bolts 312 receiving the fixing screws 42 and a pair of mating bolts 313 receiving the mating screws 43.

Referring to FIGS. 1 and 4, the bottom plate 32 comprises a pair of mating holes 323, each having a larger diameter than that of the screw cap of the mating screw 43, so that the screw caps of the mating screws 43 can be received in the mating holes 323, and never overtops an upper surface of the bottom plate 32 during the screwing of the mating screws 43 onto the mating bolts 313, i.e. the mating screws 43 are limited in but never separate from the mating holes 323 of the bottom plate 32. The bottom plate 32 further comprises a plurality of fixing holes 322, each having a smaller diameter than that of the screw cap of the fixing screw 42, so that when the fixing screws 42 go through the corresponding fixing holes 322 and are screwed with the corresponding fixing bolts 312, the bottom plate 32, the bottom shell 12 and the fixing board 31 are tightly fastened.

Figure 3:
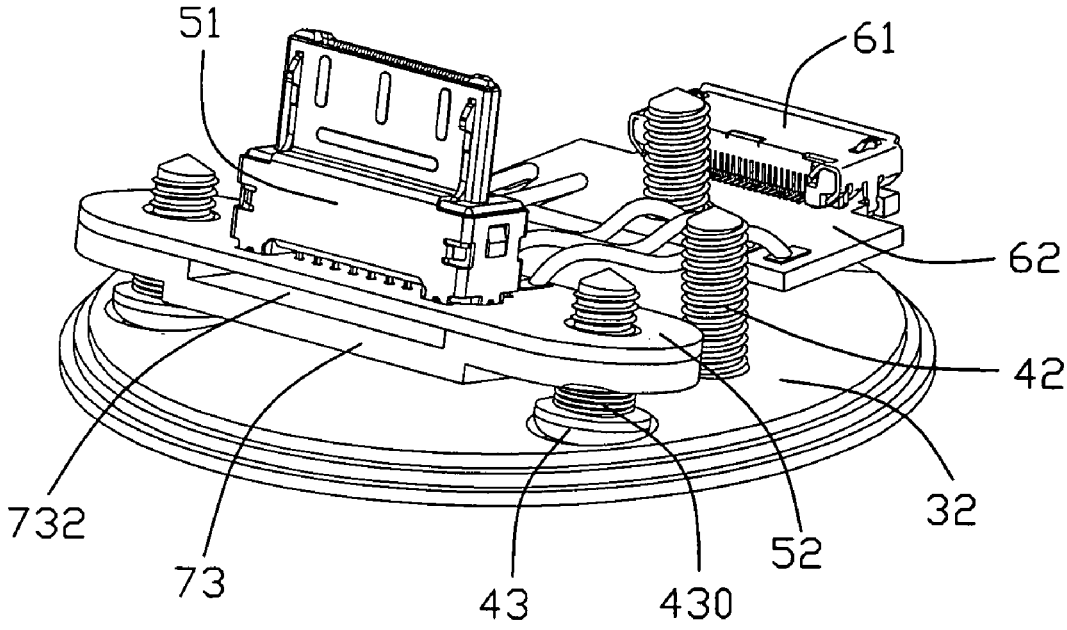
FIG. 3 is a partial view of the electrical connector assembly.

Referring to FIGS. 1, 3 and 5, the first PCB 52, the base 73 and a pair of springs 430 are in turn located between the mating bolts 313 and the mating screws 43 along a vertical direction. The first connector module 51 is soldered onto the first PCB 52 for mating with the first complementary electrical connector. The first PCB 52 forms a pair of first limiting holes 521 at two ends thereof and a plurality of first soldering pads 520 where the cable wires 71 are soldered on. The base 73 comprises a pair of second limiting holes 731 at two ends thereof corresponding to the first limiting holes 521 in a vertical direction and a depressed portion 732 in the middle. The springs 430 are supported by the mating screws 43, thus, when the first complementary electrical connector is assembled onto the first connector module 51, the first connector module 51 is pressed so as to push the first PCB 52 and the base 73, accordingly, the springs 430 are compressed. By the springs 430, a user can sense a distance that the first connector module 51 and the first PCB 52 goes across along the vertical direction, and also, it avoids an excess strength from destroying the electrical connector assembly 100.

Figure 2:
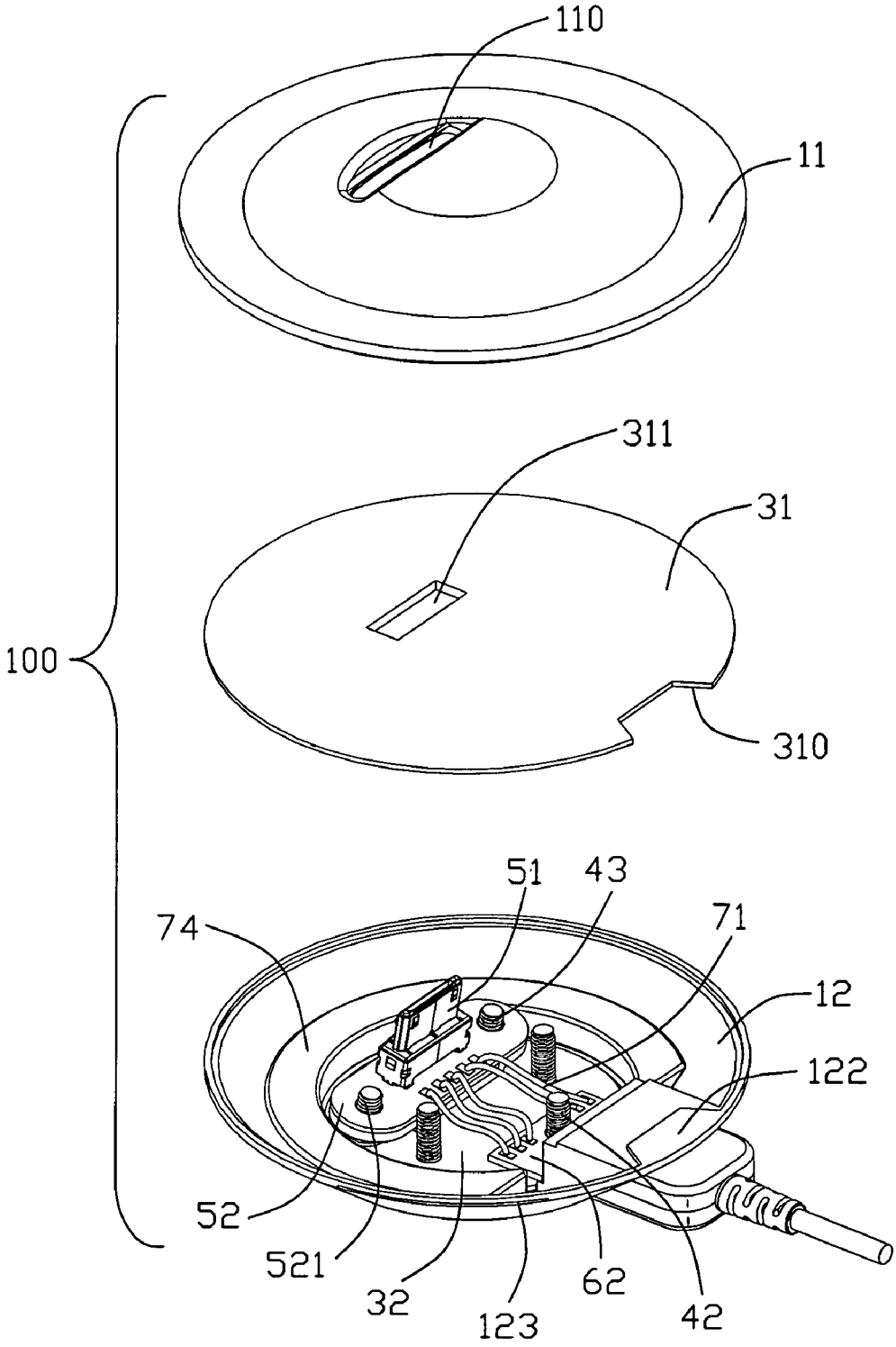
FIG. 2 is a perspective, partly assembled view of the electrical connector assembly.

Referring to FIGS. 1-3, the second connector module 61 is soldered onto the second PCB 62. The second PCB 62 forms a plurality of second soldering pads 620 electrically connecting with the first soldering pads 520 by the cable wires 71. The second PCB 62 comprises a third limiting hole 621. One of the fixing screws 42 extends through the third limiting hole 621 and is received in the corresponding fixing bolt 312, and the second connector module 61 is received in the receiving portion 121 of the bottom shell 12, thus, the second connector module 61 and the second PCB 62 are received in the receiving room formed by the fixing board 31, the bottom plate 32 and the bottom shell 12 firmly. The second connector module 61 contacts with a second complementary electrical connector (not labeled) through the second cutout.

In fact, the fixing board 31 is not so much needed, it only confines the first and the second connector modules 51, 61, the first and the second PCBs 52, 62 and the cable wires 71 in a special receiving room for more stability, we can also put the fixing bolts 312 receiving the fixing screws 42 and the mating bolts 313 receiving the mating screws 43 on the top shell 11, so that the first and the second connector modules 51, 61, the first and the second PCBs 52, 62 and the cable wires 71 are received in a receiving room formed by the top shell 11, the bottom shell 12 and the bottom plate 32. And another, we can also consider the bottom plate 32 as a part of the bottom shell 12, i.e., The bottom shell 12 with the bottom plate 32, shaped in a bowl, forms a receiving room with the top shell 11.

The base 73 is not so much needed that we can consider the base 73 as a part of the PCB 52, for the base 73 with the depressed portion 732 only provides a stress releasing force on the PCB 52 when the first complementary connector is inserted.

The springs 430, located between the first PCB 52 and the screw caps of the mating screws 43, by which a user can adjust the coefficient of elasticity of the springs 430 to fit different inserting force to prevent a destroying effect on the electrical connector when the complementary electrical connector is inserted.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical connector assembly, comprising:

a top shell having a cutout exposed along a vertical direction;

a bottom shell, shaped in a bowl, comprising a bottom plate and defining a receiving room with the top shell;

a connector module located vertically in the receiving room and extending through the cutout;

a printed circuit board (PCB), electrically connecting with the connector module and comprising a pair of limiting holes;

a pair of mating screws having threads and screw caps, the threads passing through the bottom plate and the corresponding limiting holes to lock with the top shell; and a pair of spring members supported by the mating screws and compressed between a bottom surface of the PCB and a top surface of the screw caps.

2. The electrical connector assembly as described in claim 1, further comprising a second PCB and a second connector module soldered with the second PCB both located in the receiving room, and wherein the two PCBs electrically connect with each other by cable wires.

3. The electrical connector assembly as described in claim 2, wherein the second connector module is located horizontally.

4. The electrical connector assembly as described in claim 3, further comprising a second cutout formed on the bottom shell with a mouth exposed along a horizontal direction and wherein the second connector module partly extends through the second cutout.

5. The electrical connector assembly as described in claim 4, wherein the top shell forms a pair of mating bolts receiving the threads of the mating screws, and the screw caps of the mating screws are limited by but not fixed onto the bottom plate.

6. The electrical connector assembly as described in claim 5, further comprising a plurality of fixing screws having threads and screw caps.

7. The electrical connector assembly as described in claim 6, wherein the top shell forms a plurality of fixing bolts receiving the threads of the fixing screws, and the screw caps of the fixing screws are locked with the bottom plate.

8. The electrical connector assembly as described in claim 4, further comprising a fixing board located between the top shell and the bottom shell.

9. The electrical connector assembly as described in claim 8, wherein the fixing board forms a pair of mating bolts receiving the threads of the mating screws, and the screw caps of the mating screws are limited by but not fixed onto the bottom plate.

10. The electrical connector assembly as described in claim 9, wherein the fixing board forms a plurality of fixing bolts, a plurality of fixing screws pass through the bottom plate and are received in corresponding fixing bolts.

11. The electrical connector assembly as described in claim 10, wherein the fixing board forms an opening and the bottom shell forms a protruding portion received in the opening.

12. The electrical connector assembly as described in claim 1, wherein the top shell forms a plurality of hooks, and the bottom shell forms a plurality of slots locked with the hooks.

13. The electrical connector assembly as described in claim 1, wherein a base with a depressed portion is located between the PCB and the springs.

14. The electrical connector assembly as described in claim 13, wherein the limiting holes comprise first limiting holes, and the base comprises a pair of second limiting holes overlapped with the first limiting holes along the vertical direction.

15. The electrical connector assembly as described in claim 1, wherein the bottom plate is separately attached to the bottom shell.

16. The electrical connector assembly as described in claim 1, further comprising a metal frame received in the bottom shell.

17. The electrical connector assembly as described in claim 1, further comprising a bottom board made of rubber material.

18. An electrical connector assembly comprising:

a casing comprising a top shell and a bottom shell with a receiving room defined therein, the top shell defining a top face and the bottom shell defining a circular wall;

a connector essentially disposed in the receiving room of the casing with a mating port exposed on said top face, said connector including a plurality of contacts; and a printed circuit board on which the connector is seated and to which the contacts are electrically connected; wherein the printed circuit board and the associated connector are allowed to be downwardly moved under a cushiony manner via a biasing member.

19. The electrical connector assembly as claimed in claim 18, further including another connector disposed in the receiving room of the casing with another mating port exposed on said lateral wall, and wherein said another connector has a plurality of terminals electrically connected to another printed circuit board and wherein said two printed circuit boards connect with each other via internal cables.

20. The electrical connector assembly as claimed in claim 19, wherein said another connector is positioned with regard to the casing in a stationary manner.

* * * * *